US006651954B1

(12) United States Patent
Porcher et al.

(10) Patent No.: US 6,651,954 B1
(45) Date of Patent: Nov. 25, 2003

(54) ELECTROMAGNETIC VALVE ACTUATOR

(75) Inventors: Yves Porcher, Le Plessis-Bouchard (FR); Calogero Fiaccabrino, Cergy (FR); Lucien Donce, Magny-en-Vexin (FR); Thierry Lanoe, Osny (FR)

(73) Assignee: Johnson Controls Automotive Electronics, Osny (FR)

( * ) Notice: Subject to any disclaimer, the term of this patent is extended or adjusted under 35 U.S.C. 154(b) by 0 days.

(21) Appl. No.: 09/806,711

(22) PCT Filed: Oct. 4, 1999

(86) PCT No.: PCT/FR99/02356

§ 371 (c)(1),
(2), (4) Date: Apr. 4, 2001

(87) PCT Pub. No.: WO00/20731

PCT Pub. Date: Apr. 13, 2000

(30) Foreign Application Priority Data

Oct. 6, 1998 (FR) ..... 98 12489
Oct. 15, 1998 (FR) ..... 98 12940

(51) Int. Cl.[7] ..... F16K 31/02
(52) U.S. Cl. ..... 251/129.09; 123/90.11
(58) Field of Search ..... 251/129.09, 129.18, 251/129.16; 123/90.11

(56) References Cited

U.S. PATENT DOCUMENTS 4,455,497 A * 6/1984 Shtrikman ..... 310/30
5,207,239 A * 5/1993 Schwitalla ..... 137/870
5,515,818 A * 5/1996 Born ..... 123/90.11
5,548,263 A * 8/1996 Bulgatz et al. ..... 123/90.11
5,690,064 A * 11/1997 Izuo ..... 123/90.11
5,730,091 A * 3/1998 Diehl et al. ..... 123/90.11
5,799,926 A * 9/1998 Moriya et al. ..... 123/90.11
5,961,097 A * 10/1999 Zimmermann ..... 123/90.11
6,078,235 A * 6/2000 Schebitz et al. ..... 123/90.11
6,397,798 B1 * 6/2002 Fiaccabrino ..... 123/90.11

FOREIGN PATENT DOCUMENTS

FR 2 808 375 A1 * 4/2000 ..... H01F/7/06
FR 1 132 581 A1 * 3/2001 ..... F01L/9/04

* cited by examiner

*Primary Examiner*—Gene Mancene
*Assistant Examiner*—Melvin Cartagena
(74) *Attorney, Agent, or Firm*—Foley & Lardner

(57) ABSTRACT

The electromagnetic valve actuator has an armature (22) of ferromagnetic material fixed to the stem of the valve, springs are provided to hold the valve at rest in a middle position between a fully open position and a closed position, and a single coil (38) is mounted on a ferromagnetic circuit. In combination with the armature, the magnetic circuit presents two stable magnetic flux paths both of which correspond to an airgap of small size.

12 Claims, 3 Drawing Sheets

ELECTROMAGNETIC VALVE ACTUATOR

BACKGROUND

The invention relates to an electromagnetic actuator for moving a valve in translation so as to bring it alternately into an open position and into a closed position. A major application of the invention lies in controlling the valves of internal combustion engines, with spark ignition or compression ignition.

At present, the valves on most internal combustion engines are actuated by a cam shaft driven by the engine. The opening and closing velocities of valves controlled by a cam shaft are small when the engine is running slowly, in particular on starting, which is not favorable to filling the combustion chambers.

Proposals have also been made (U.S. Pat. No. 4,614,170) for an electromagnetic actuator that enables the above-mentioned drawbacks to be reduced, the actuator having a ferromagnetic armature fixed to the stem of the valve, resilient return means for holding the valve at rest in a middle position between its fully open and closed positions, and electromagnetic means for moving the valve in both directions in alternation. The electromagnetic means described in document U.S. Pat. No. 4,614,170 have a first ferromagnetic core electromagnet placed on one side of the armature which, when excited, attracts the armature causing it to tend to close the valve, and a second electromagnet placed on the other side of the armature which, when excited, tends to bring the valve into its fully open position.

The valve and spring assembly constitutes an oscillating system excited by periodically powering the electromagnets in alternation. The electromagnet acting on the armature in the valve-opening direction begins to be powered when the armature is approaching a location in a hich it sticks to the core of the electromagnet.

SUMMARY

The invention seeks in particular to provide an electromagnetic actuator that satisfies practical requirements better than those in the prior art, in particular by being of reduced size and requiring fewer connections.

For this purpose, the electromagnetic means comprise a single coil mounted on a ferromagnetic circuit of structure such that, in combination with the armature, it presents two stable paths for magnetic flux, each corresponding to an airgap of small size (generally no gap).

One of the configurations corresponds to the valve being fully open, and the other to the valve being closed.

In its initial state, in a middle position, the armature generally presents position or magnetic circuit unbalance because the direction in which it is attracted when the coil is first powered is predetermined. This unbalance can be provoked deliberately. For example, when the resilient return means are constituted by two springs placed on respective sides of the armature, the two springs can be such as to give the armature at rest a position in which the force that results from powering the coil acts in a determined direction and that they present the same potential energy in compression both in the closed position and in the fully open position.

An advantageous manner of unbalancing the magnetic forces acting up and down is to cause the flux in the central portion to be asymmetrical by acting on a lamination notch profile and/or on an armature profile.

To provide asymmetry, the armature can have an axial projection. Another manner of creating asymmetry consists in giving the poles of the ferromagnetic circuit and the armature shapes such that the contacting surfaces in both stable paths are different.

Since it has a single coil only, the actuator is more compact than prior actuators. Its electrical circuit and control are simpler and less expensive.

The above characteristics and others that are advantageously used in association with the preceding characteristics, but which can be used independently, will appear more clearly on reading the following description of particular embodiments given as non-limiting examples.

BRIEF DESCRIPTION OF THE DRAWINGS

The description refers to the accompanying drawings, in which.

DETAILED DESCRIPTION OF THE EXEMPLARY EMBODIMENTS

Figure 1:
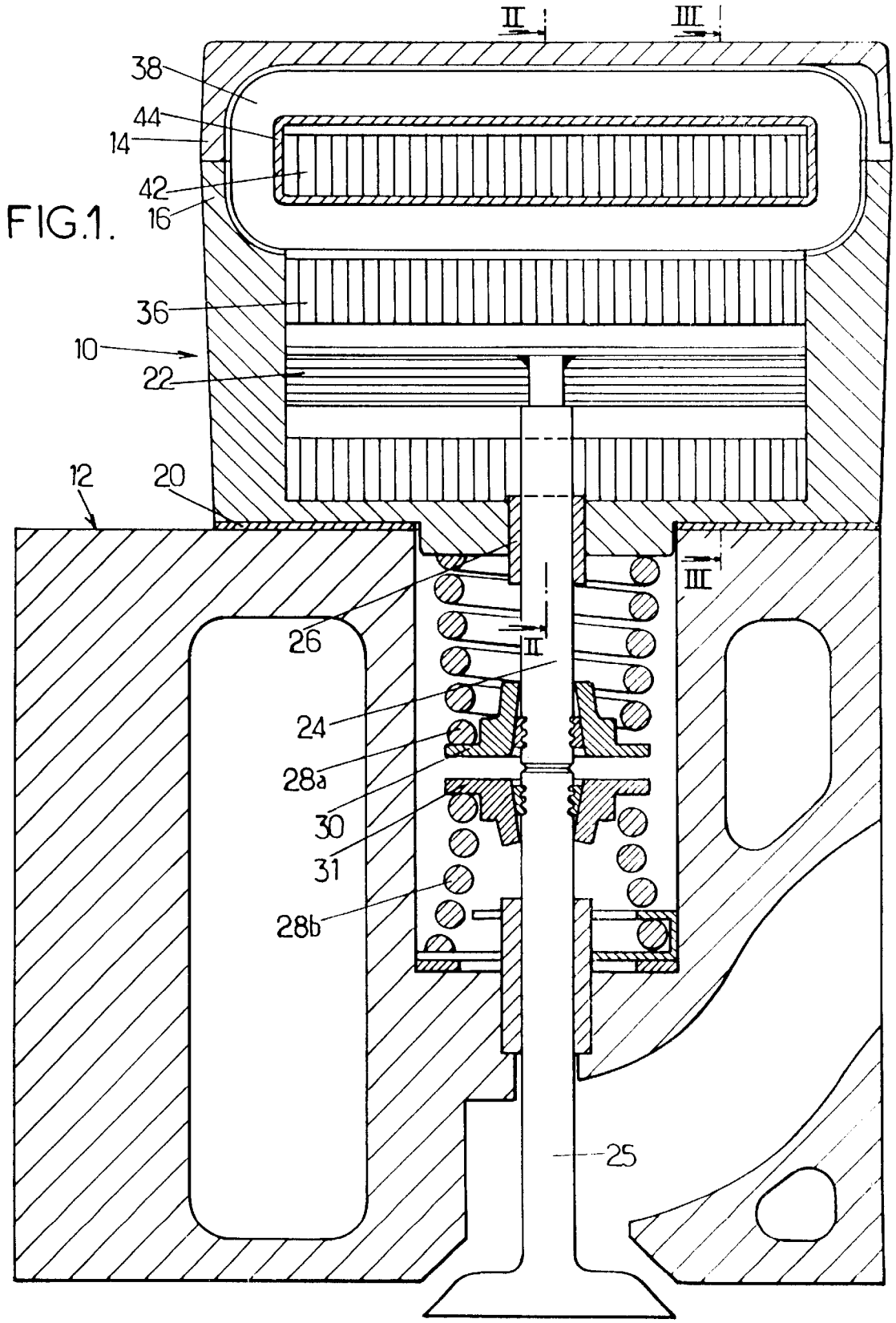
FIG. 1 shows a valve actuator constituting an embodiment of the invention, in section on a plane containing the axis of the valve.
Figure 3:
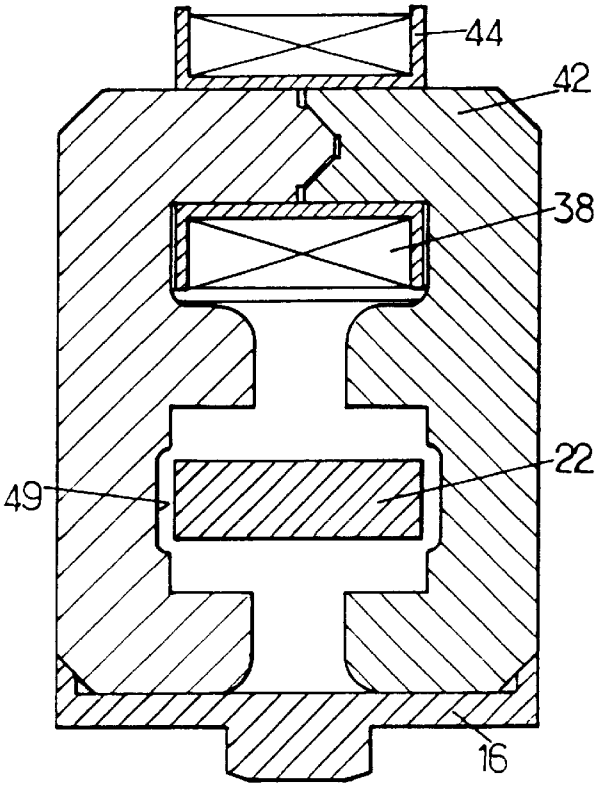
FIGS. 2 and 3 are fragmentary sections of the electromagnetic portion on lines II—II and III—III.
Figure 2:
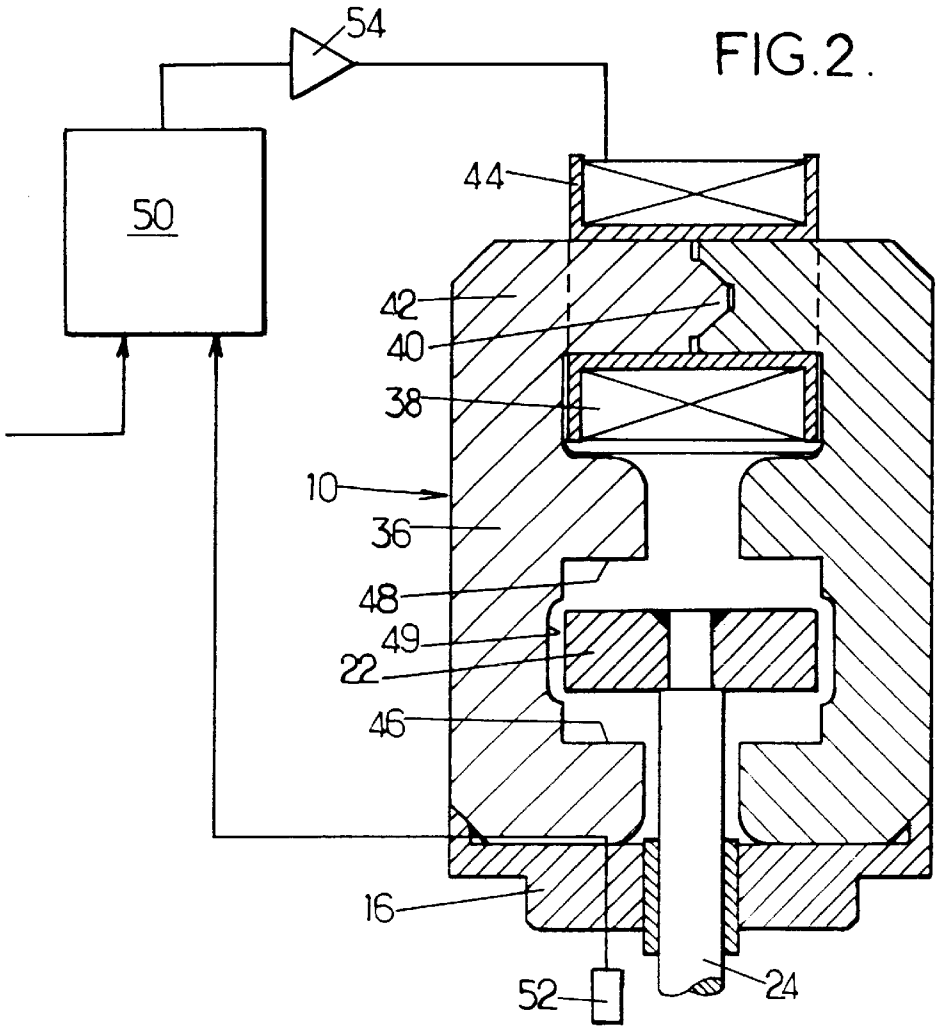

The actuator 10 shown in FIGS. 1 to 3 is constituted by an assembly for mounting on the cylinder head 12 of an engine. It comprises a housing made up of a plurality of parts 14 and 16 which are stacked and assembled together by means that are not shown, e.g. screws. These parts are made of non-ferromagnetic material, e.g. of light alloy. The housing can be fixed on the cylinder head 12 via a piece of shim 20 that is likewise made of non-ferromagnetic material.

The actuator has an armature 22 of ferromagnetic material which is advantageously laminated so as to reduce losses, and which is fixed on a rod 24 for driving the valve 25. In general, a plurality of valves are mounted side by side and there is only a small amount of width available for each actuator in a direction perpendicular to the plane of FIG. 1. As a result the armature is given a rectangular shape. The armature cannot turn in the part 16. The rod 24 can be fixed to the armature by welding and it can be guided by a ring 26 fixed to an annular extension of the part 16.

In the embodiment shown, the stem of the valve 25 is separate from the rod 24. It is guided by a ring which is fixed to the cylinder head and it is free to turn therein.

Two return springs 28*a* and 28*b* are provided to hold the valve at rest in a position that is substantially halfway between the closed position and the fully open position. One of the springs 28*a* is compressed between a plate 30 fixed to the rod 24 and remote from the part 16. The other spring 28*b* is compressed between a plate 31 fixed to the valve stem and the bottom of a valve well formed in the cylinder head. The distribution clearance between the raised rod and the closed valve guarantees sealing. The actuator could equally well be used with a single spring operating in traction and compression and associated with a resilient damper guaranteeing sealing when the valve is closed, as described in French patent No. 98/11670. The rod can then be integral with the valve.

The housing contains a core of ferromagnetic material 36, which is advantageously laminated, and which co-operates with the armature and a coil 38 placed inside the core to define a ferromagnetic circuit. The core shown can be made of two complementary portions, bearing against each other in a plane 40 (FIG. 2) or it can be made as a single piece. The laminations making up each half of the core are E-shaped (FIGS. 2 and 3). The top branches 42 engage in the coil 36 which they support via a former 44. The other two branches of each half define a travel volume for the armature. When the armature bears against the bottom 46 of the volume, that defines the fully open position of the valve. The ceiling 48 of the volume is at a location relative to the seat of the valve such that the airgap is practically zero when the valve is closed. A middle notch 49, corresponding to the rest position of the armature 22 can be provided inside the chamber with a length that is slightly greater than the thickness of the armature. Above and below the notch, the wall of the travel volume leaves only enough clearance for travel. The core could equally well be constituted as a single piece and have a coil wound thereon by an automatic machine, thus avoiding the presence of an airgap and guaranteeing the accuracy of the notches 49.

Figure 4:
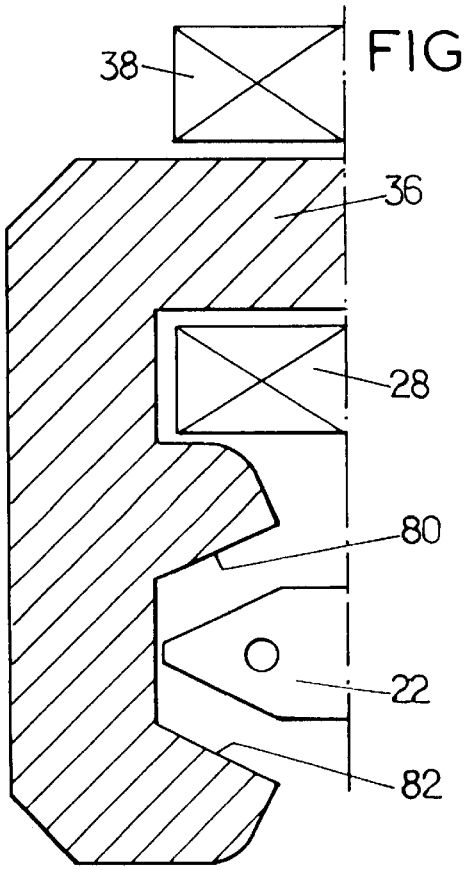
FIGS. 4 and 5 show variants of FIGS. 1 to 3.

In the variant embodiment shown in FIG. 4, the armature 22 (which is advantageously laminated or made of a material having high electrical resistivity) presents edges that are chamfered parallel to the poles of the core 36 (FIG. 4). With this disposition, the armature is not magnetically saturated in its operating range and flux is closed mainly by passing through the armature, given the shape of the pole pieces of the core. In another variant, which is advantageous because it determines the initial direction in which the armature 22 moves starting from its rest position, the asymmetry of the top flux circuit relative to the bottom flux circuit is emphasized by having different slopes for the top and bottom pole surfaces 80 and 82 of the core, each of the surfaces of the armature facing a pole being parallel with that pole.

Figure 5:
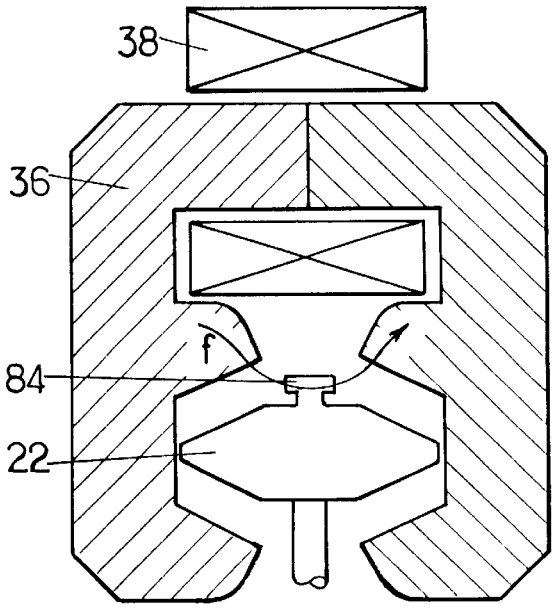

In yet another variant embodiment, as shown in FIG. 5, the armature 84 has a central projection in the form of a bar which increases the asymmetry of the magnetic circuit. When the armature 22 is in the rest position in which it is shown in FIG. 5 and when magnetic flux is generated by the coil 38, the flux closes by passing via the projection 84 as represented by arrow f, thereby reducing the size of the airgaps. When the armature sticks against the core, in its topmost position, this projection is short-circuited and does not weaken the sticking forces. This disposition considerably reduces reluctance in the rest position and increases the ease with which the device can be set into operation.

The assembly constituted by the armature, the valve, and the spring constitutes an oscillating system having a resonant frequency. During an initial stage of operation, the moving equipment constituted by the valve and the armature is attracted alternately upwards and downwards by applying pulses of electricity to the coil at a frequency which is close to the resonant frequency of the system. The coil 38 is initially powered for a duration that corresponds to a fraction of the resonant period, thereby causing the armature to move through a small amplitude. If the system is asymmetrical, which can be the result of:

an asymmetrical shape for the notches 49;

asymmetry of the armature; and/or the presence of a projection (FIG. 5);

then the direction in which the armature moves initially is determined.

The current carried by the coil 38 can be controlled by monitoring the position of the armature 22 by means of a position sensor integrated in the device. Current pulses are delivered to the coil at instants such that when force is applied the velocity of the armature is in the same direction as the applied force. Since the initial force is of given sign, due to the asymmetry, it suffices to apply one pulse per period.

Figure 6:
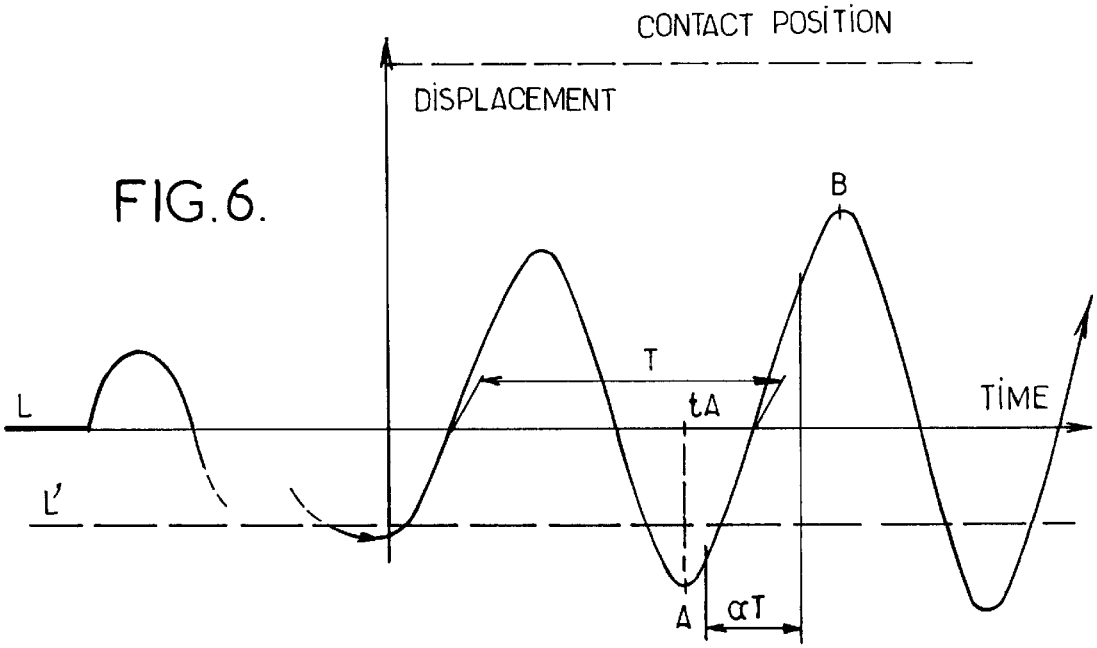
FIG. 6 is a diagram showing how armature oscillation varies when the device is started.

FIG. 6 is a diagram showing the device being started up. Initially, the armature is in a position corresponding to the line L, in which the forces exerted by the springs 28*a* and 28*b* are in balance. This position is offset from the position L' in which the electromagnetic force exerted on the armature 22 by the field created by the coil 38 is zero. The first current pulse in the coil 38 causes the armature to move away, and subsequently to return with its resonant period to a position which is generally above that marked by the line L'. The amplitude of the oscillations increases progressively. Tracking the position signal makes it possible at all times to know the most recent duration T between two successive zero crossings. From a zero crossing instant and the duration T it is possible to deduce the instant tA at which an extreme position A is reached. From the following zero crossing instant (crossing the line L), as given by the sensor, it is possible to deduce an optimum instant for applying voltage so as to cause the current to increase. The duration of the application can be that given by $\alpha T$ in FIG. 6, for example. At the end of this period, the control voltage is reversed to cause current to decrease. The delay in applying the voltage, and the instant at which it is reversed are selected as a function of the ability of the current to vary quickly in the coil. In practice, the voltage can often be applied immediately on passing through the extremum A. Voltage reversal after the time interval $\alpha T$ enables the current to decrease before reaching the extremum B where velocity reverses. The current must have returned to zero at this instant in order to avoid braking the moving equipment.

The process is continued until the amplitude of the motion is such that the armature sticks against the cylinder head. From that moment on, under steady conditions, it suffices to power the coil at full power solely during the time necessary for returning the moving equipment into its extreme position followed by lower holding current until the moving equipment is caused to move in the opposite direction.

In FIG. 2, the sensor 52 is connected to a processor 50 which controls the power supplied to the coil 38 via an amplifier 54. The sensor 52 can be carried by the housing 16 and it can project downwards so as to detect the approach of the plate 30 which, for this purpose, is made of magnetic material. On the basis of the signal output by the sensor 52, the processor 50 (which can be the processor controlling the engine), can determine the position reached by the moving equipment.

By varying the signal it delivers, the sensor 52 can also make it possible to determine the instant at which the amplitude of the oscillation of the moving equipment brings it into its extreme position.

From that point onwards, control can be performed by means of the kind described in patent application FR 98/12940 in the name of the Applicant.

More generally, startup can be achieved in a minimum length of time by associating position measurement with an algorithm for setting the armature into motion which controls the current taken by the coil so as to avoid ever generating magnetic forces that provide braking.

The invention can be embodied in numerous ways. The springs 28*a* and 28*b* can be placed one inside the other, for example, in order to reduce the size of the housing. Each coil can be constituted by a number N of windings that is greater than 1 (e.g. two or three) that are powered in parallel, thereby dividing resistance by N and increasing the maximum total current, and also dividing inductance by N. Electrical inertia is decreased. The dynamic behavior of the engine system is improved. Breaking a winding wire does not put the device out of operation. Dynamic behavior is improved: the magnetic field can be varied more quickly because the ratio of inductance over resistance is unchanged while the resistance of each winding is a fraction of the resistance of a single coil: the maximum current is higher and since inductance is lower, dynamic response is quicker.

What is claimed is:

1. An electromagnetic valve actuator comprising an armature of ferromagnetic material for driving a stem of a valve, resilient return means provided for holding the valve at rest in a middle position between a fully open position and a closed position, and a ferromagnetic circuit having separate branches defining a travel volume for the armature and connected to a common branch on which is mounted a single coil so that, in combination with the armature, the ferromagnetic circuit presents two stable magnetic flux paths, each corresponding to a small or zero airgap and one corresponding to the valve being fully open and the other to the valve being closed.

2. An actuator according to claim 1, characterized in that the ferromagnetic circuit is such that the small airgap values are substantially zero.

3. An actuator according to claim 1, characterized in that the ferromagnetic circuit is constituted by a laminated core made up of two halves bearing against each other, and presenting notches at half stroke.

4. An actuator according to claim 3, characterized in that each half of the laminated core is E-shaped having a top branch which engages in the coil and having lower branches that define a travel volume for the armature.

5. An actuator according to claim 4, characterized in that the volume presents a middle enlargement corresponding to the rest position of the armature.

6. An actuator according to claim 1, having a sensor for sending the position of equipment constituted by the armature and the valve.

7. An actuator according to claim 1, characterized in that the resilient return means are designed to give the armature an asymmetrical position in the ferromagnetic circuit.

8. An actuator according to claim 1, characterized in that the armature carries an axial projection for creating asymmetry in the magnetic circuit.

9. An actuator according to claim 1, characterized in that the ferromagnetic circuit and the armature are of a structure such that the contacting surfaces are different for the two stable magnetic flux paths.

10. An actuator according to claim 1, characterized in that the ferromagnetic circuits have middle notches offset in the opening or closing direction to make the ferromagnetic circuits asymmetrical and to define an initial travel direction for the armature.

11. An actuator according to claim 10, characterized in that the coil is constituted by a number N of parallel windings where N is greater than 1.

12. An actuator according to claim 1, characterized in that the ferromagnetic circuit is constituted by a one-piece core, having notches at half stroke.

* * * * *